US005379994A

United States Patent [19]

Kushida

[11] Patent Number: 5,379,994

[45] Date of Patent: Jan. 10, 1995

[54] SHEET SUPPLY DEVICE FOR ALIGNING A SHEET AT A REFERENCE POSITION

[75] Inventor: Tsuyoshi Kushida, Nagoya, Japan

[73] Assignee: Brother Kogyo Kabushiki Kaisha, Nagoya, Japan

[21] Appl. No.: 86,901

[22] Filed: Jul. 7, 1993

[30] Foreign Application Priority Data

Jul. 23, 1992 [JP] Japan ..... 4-197054

[51] Int. Cl.[6] ..... B65H 3/44; B65H 7/02

[52] U.S. Cl. ..... 271/9; 271/227; 271/265

[58] Field of Search ..... 271/9, 227, 265

[56] References Cited

U.S. PATENT DOCUMENTS

| | | | |
|---|---|---|---|
| 4,982,228 | 1/1991 | Watanabe | 271/227 X |
| 5,018,718 | 5/1991 | Matsuno et al. | 271/227 X |
| 5,056,775 | 10/1991 | Kida | 271/227 |
| 5,228,680 | 7/1993 | Sugiura | 271/265 |

FOREIGN PATENT DOCUMENTS

| | | | |
|---|---|---|---|
| 118640 | 7/1984 | Japan | 271/227 |

*Primary Examiner*—Robert P. Olszewski
*Assistant Examiner*—Boris Milef
*Attorney, Agent, or Firm*—Oliff & Berridge

[57] ABSTRACT

According to the sheet supply device of this invention, a sheet supplied from a sheet supply cassette is fed to a reference position. On the basis of a distance between where the sheet is fed from the reference position to where a tip portion of the sheet is detected by a sheet detection sensor, a sheet feed amount is determined. The sheet feed amount corresponds to the position where the sheet will be fed to a sheet supply completion position after the tip portion of the sheet is detected by the sheet detection sensor. Accordingly, the tip portion of the fed sheet is accurately located at the sheet supply completion position. Thus, an image can be formed at a predetermined position on the sheet through printing, copying or other image-forming operations.

20 Claims, 5 Drawing Sheets

SHEET SUPPLY DEVICE FOR ALIGNING A SHEET AT A REFERENCE POSITION

BACKGROUND OF THE INVENTION

1. Field of the Invention

This invention relates to a sheet supply device for use in a reproduction device, such as a printing device or a copying machine. More particularly, the invention relates to a sheet supply device for enabling an image to be formed at a predetermined position on a sheet through a reproduction operation, such as a printing operation or a copying operation.

2. Description of Related Art

FIG. 5 shows a conventional sheet supply device for use in a reproduction device, such as a printing device or copying machine. As shown, a sheet supply device 40 comprises a pair of sheet feeding rollers 7, a sheet detection sensor 9 for manually-inserted sheets 18, a pair of sheet supply rollers 11 for manually-inserted sheets 18, a cassette sheet supply roller 13, and a sheet supply cassette 17. At the left side of the sheet supply device 40 are an opening 40A, through which the sheet supply cassette 17 is insertable, and a feeder 19, through which a sheet is manually insertable. In addition, the sheet supply device 40 includes therein a sheet supply passageway 21 through which a manually-inserted sheet 18 from the feeder 19 is fed to the sheet feeding rollers 7, a sheet supply passageway 23 through which sheets 15 stacked in the sheet supply cassette 17 are individually fed to the sheet feeding rollers 7, and a sheet supply passageway 25 through which the sheet 15 or the manually-inserted sheet 18 is further fed by the sheet feeding rollers 7.

In this sheet supply device 40, the sheets 15 stored in the sheet supply cassette 17 in a stack form are individually separated from one another and fed through the sheet supply passageway 23 to the rollers 7. The manually-inserted sheet 18 fed through the feeder 19 is detected by the manually-inserted sheet detection sensor 9 and fed through the sheet supply passageway 21 to the sheet feeding rollers 7 by the sheet supply rollers 11. The sheet 15 or the manually-inserted sheet 18 is nipped by the pair of rotating sheet feeding rollers 7 and fed toward a sheet supply completion position 29.

In this sheet supply device 40, in order to accurately form an image at a predetermined position on a sheet in this device 40, the position of a tip portion of the fed sheet 15 or 18 must be accurately located at the sheet supply completion position 29. Therefore, the contact point between the pair of the sheet feeding rollers 7 is used as a reference position 28. The sheet detection sensor 5 for detecting the sheet 15 or 18 is provided at a predetermined position in the sheet supply passageway 25 between the reference position 28 and the sheet supply completion position 29 located a predetermined distance from the reference position 28. When the tip portion of the fed sheet 15 or 18 is detected by the sheet detection sensor 5, the sheet 15 or 18 is further fed toward the sheet supply completion position 29 a predetermined amount by the sheet feeding rollers 7. So, the tip portion of the sheet 15 or 18 is located at the sheet supply completion position 29. Accordingly, this sheet supply device is designed to be hardly influenced by a feeding error of the sheet 15 or 18 due to positional deviation of the sheet or due to sheet slippage during a feeding operation of the sheet by the rollers 11 and 13.

However, frequently the sheet detection sensor 5 is not accurately secured at the predetermined position of the sheet supply passageway 25. Therefore, even when the sheet 15 or 18 is fed toward the sheet supply completion position 29 by a predetermined amount after the sheet 15 or 18 is detected by the sheet detection sensor 5, the tip portion of the sheet 15 or 18 is fed to a deviated position that differs from the sheet supply completion position 29 by an amount corresponding to sensor 5 securing error. As a result, an image can not be accurately printed or copied at a predetermined position on a sheet 15 or 18.

In addition, the sheet detection sensor 5 has an inherent read-out (detection) error itself. The same positional deviation problem as described above will also occur due to this error.

SUMMARY OF THE INVENTION

An object of this invention is to provide a sheet supply device that can accurately feed a sheet to a sheet supply completion position to form an image at a predetermined position on the sheet through a reproduction operation.

To attain the above and other objects, the sheet supply device according to this invention includes first sheet feeding means for feeding a sheet to a first position, guide means for guiding the sheet from the first position to a second position away from the first position at a predetermined distance, and second feeding means for feeding the sheet from the first position to the second position along the guide means. Detection means is provided at a predetermined position between the first position and the second position for detecting a tip portion of the sheet fed by the second feeding means. A residual distance determining means determines a residual distance from the position of the detection means to the second position on the basis of both of the predetermined distance and a sheet feed amount. The sheet feed amount is the distance at which the sheet is fed by the second sheet feeding means until the tip portion of the sheet fed from the first position to the second position is detected by the detection means. Control means controls the sheet feeding means to feed second and subsequent sheets fed to the position of the detection means to the second position in accordance with the residual distance determined by the residual distance determining means.

According to the sheet supply device of this invention thus constructed, the first sheet feeding means first feeds the sheet to the first position. Then, the second sheet feeding means feeds the sheet from the first position to the second position. The second position is spaced from the first position at a predetermined distance along the guide means. At this time, the detection means disposed at the predetermined position between the first position and the second position detects the tip portion of the sheet fed by the second feeding means. The residual distance determining means determines the residual distance from the position of the detection means to the second position on the basis of the predetermined distance and the feed amount of the sheet. The sheet is fed by the second sheet feeding means until the tip portion of the sheet fed from the first position to the second position is detected by the detection means. The control means controls the second sheet feeding means to accurately feed the second and subsequent sheets fed to the position of the detection means to the second position.

As is apparent from the foregoing, according to the sheet supply device of this invention, regardless of the source of the sheet, i.e., by manual insertion or from the sheet supply cassette, the tip portion of the sheet can be accurately fed to the sheet supply completion position. Therefore, this invention has a remarkable effect on the reproduction industry in that an image can be surely printed or copied at a predetermined position on a sheet.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

Figure 1:
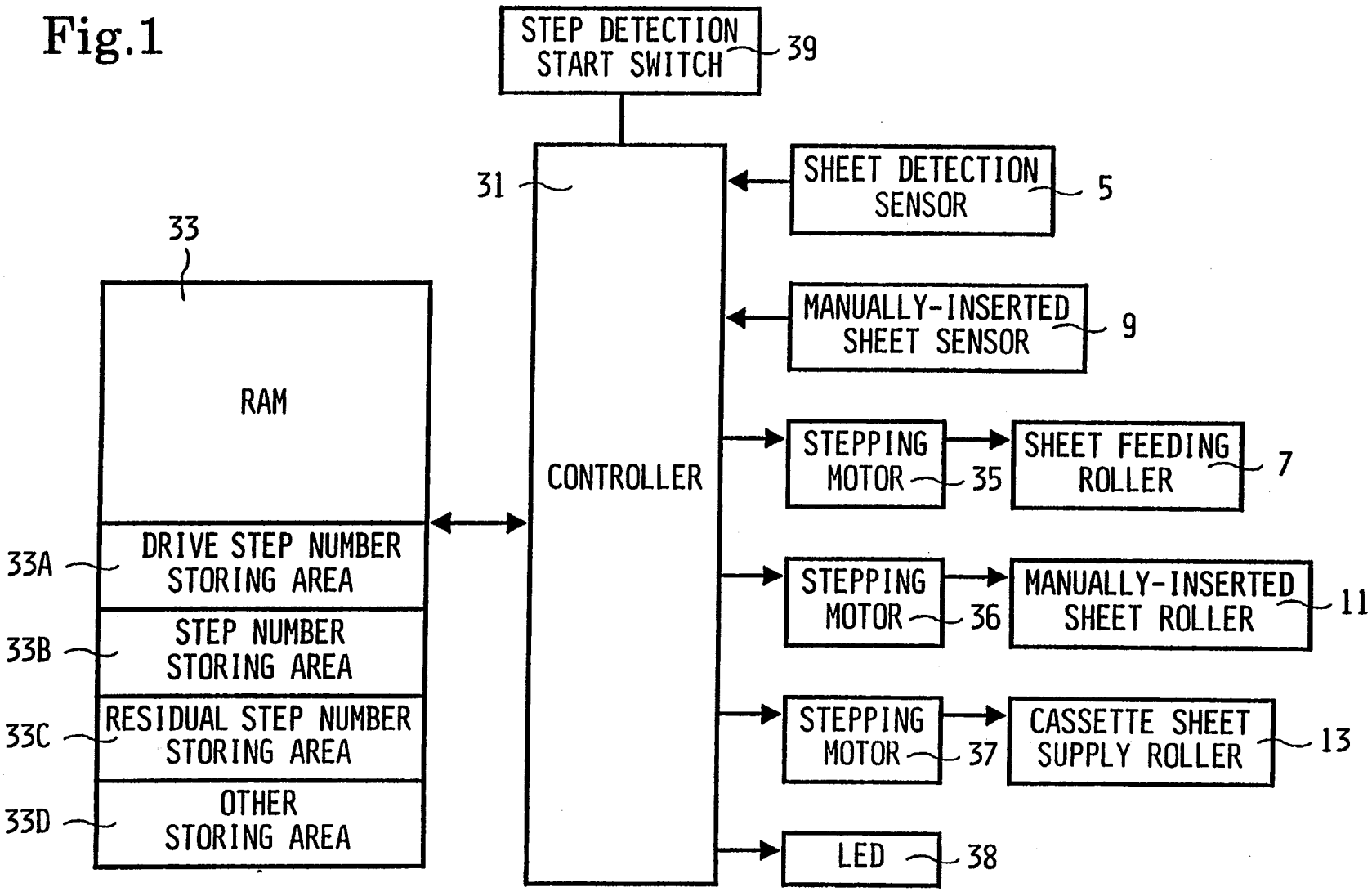
FIG. 1 is a schematic diagram showing a sheet supply device according to this embodiment.

A preferred embodiment of this invention is described with reference to the accompanying drawings.

First, the construction of the sheet supply device 1 of this embodiment is schematically described with reference to FIG. 2. The sheet supply device 1 has the same schematic construction as the conventional sheet supply device 40, and, thus, the same elements as the conventional sheet supply device are represented by the same reference numerals.

Figure 2:
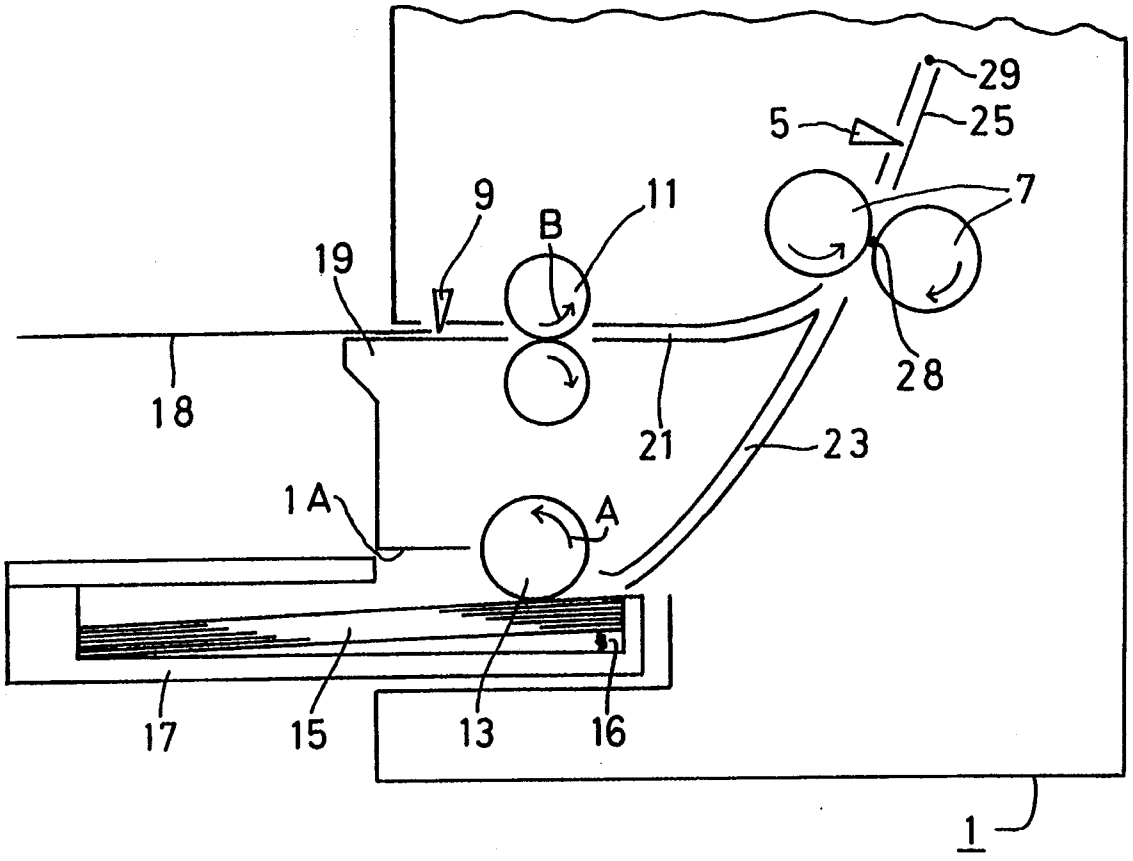
FIG. 2 is a block diagram showing the construction of the sheet supply device according to this embodiment.

As shown in FIG. 2, the sheet supply device comprises a sheet detection sensor 5, a pair of sheet feeding rollers 7, a sheet detection sensor 9 for manually-inserted sheets 18, a pair of sheet rollers 11 for manually-inserted sheets 18, a cassette sheet supply roller 13 and a sheet supply cassette 17. The sheet supply cassette 17 is insertable into an opening 1A, shown on the left side of the sheet supply device 1. Also shown on the left is a feeder 19 for supplying a manually-inserted sheet 18. Further, a sheet supply passageway 21 is provided within the sheet supply device for feeding the manually-inserted sheet from the feeder 19 to the sheet feeding rollers 7. A sheet supply passageway 23 feeds the sheets 15 to the sheet feeding rollers 7 from the sheet supply cassette 17 one by one. A sheet supply passageway 25 further feeds the manually-inserted sheet 18 or the sheet 15 from the sheet feeding rollers 7 to the sheet supply completion position 29. The sheet supply passageway 21 joins the sheet supply passageway 23 at the upstream side of the sheet feeding rollers 7.

The sheet supply cassette 17 detaches from the opening 1A and stores the sheets 15 in a stack. When the sheet supply cassette 17 is mounted into the sheet supply device 1, as shown in FIG. 2, the stacked sheets are lifted up to a contact position with the cassette sheet supply roller 13 by a spring 16.

The cassette sheet supply roller 13 is rotatably fixedly disposed at the upper side of the mounted sheet cassette 17. As described above, the sheets 15 of the sheet supply cassette 17 are lifted up by the spring 16 and contact the cassette sheet supply roller 13. Therefore, by rotating the cassette sheet supply roller 13 in a counterclockwise direction as indicated by an arrow A, the sheets 15 are individually fed from the sheet supply cassette 17 into the sheet supply passageway 23. Through the sheet supply passageway 23, the sheet 15 is guided from the sheet supply cassette 17 to a reference position 28 where the pair of sheet feeding rollers 7 contact each other.

The manually-inserted sheet detection sensor 9 is disposed adjacent to the feeder 19 of the sheet supply passageway 21. The sheet detection sensor 9 detects whether the manually-inserted sheet 18 is inserted from the feeder 19 into the sheet supply device 1.

The pair of sheet supply rollers 11 are disposed on the right-hand side of the manually-inserted sheet detection sensor 9. The sheet supply rollers 11 are rotated by a stepping motor 36 in opposite directions as indicated by an arrow B to feed the manually-inserted sheet 18 to the reference position 28 through the sheet supply passageway 21.

The pair of sheet feeding rollers 7 are rotatably fixedly disposed adjacent to the joint between the sheet supply passageway 21 and the sheet supply passageway 23. The sheet feeding rollers 7 are rotated in opposite directions as indicated by an arrow C and feed the sheet 15 or the manually-inserted sheet 18 into the sheet supply passageway 25, which has been fed from the sheet supply passageway 23 or 21, respectively. As described above, the reference position 28 is defined as the contact point between the pair of sheet feeding rollers 7.

The sheet supply passageway 25 guides the sheet 15 or the manually-inserted sheet 18 fed from the reference position 28 to the sheet supply completion position 29 by the sheet feeding rollers 7. In this embodiment, the length between the reference position 28 and the sheet supply completion position 29 is preferably set to 115/300 inch. According to the construction of the sheet supply device 1, the sheet feeding rollers 7 are accurately positioned so that the length between the reference position 28 and the sheet supply completion position 29 is accurately set to 115/300 inch, correspondingly.

The sheet supply device 1 is designed so that when the stepping motor 35 is driven by one step amount, the sheet 15 or the manually-inserted sheet 18 is fed by 1/300 inch by the sheet feeding rollers 7. Accordingly, when the stepping motor 35 is driven by an amount of 115 steps, the sheet 15 or 18 is accurately fed from the reference position 28 to the sheet supply completion position 29. As described above, the feed amount of the sheet 15 or 18 corresponds to the number of drive steps of the stepping motor 35. Thus, the feed amount of the sheet 15 or 18 from the reference position 28 is managed by the drive step number of the stepping motor 35 in this embodiment.

The sheet detection sensor 5 is secured at a position which is removed from the reference position 28 in the sheet supply passageway 25 by a predetermined distance. The sheet detection sensor 5 detects the presence or absence of the tip portion of the sheet 15 or 18 at the position where the sheet detection sensor 5 is disposed.

Next, the electrical construction of the sheet supply device 1 of this embodiment is described with reference to FIG. 1.

The controller 31 for controlling the operation of the sheet supply device 1 is connected to a random access memory (RAM) 33, the sheet detection sensor 5, the sheet sensor 9, the stepping motor 35, the stepping motor 36, the stepping motor 37 and an LED 38, respectively. The stepping motor 35 is connected to the sheet feeding rollers 7, and the stepping motor 36 is connected to sheet rollers 11. Further, the stepping motor 37 is connected to the cassette sheet supply roller 13.

The controller 31 has a generally-known construction containing a central processing unit for performing data signal processing, a read only memory (ROM) storing a program for controlling the operation of the sheet supply device 1 and data.

The RAM 33 includes a drive step number storing area 33A for storing a step number K at which the stepping motor will be driven, a step number storing area 33B for storing a step number L at which the stepping motor has been driven, a residual step number storing area 33C for storing a step number M of the stepping motor 35 that corresponds to the residual length of the sheet supply passageway 25 between the position where the tip portion of the sheet 15 is detected by the sheet detection sensor 5 and the sheet completion position 29, and other storing areas 33D which are secured for operations, etc.

The sheet detection sensor 5 outputs a signal representing the detection of the sheet 15 to the controller 31. The stepping motor 35 is controlled by the controller 31 to rotate the sheet feeding rollers 7 in the direction as indicated by the arrow C. The sheet detection sensor 9 detects the manually-inserted sheet 18 and transmits the detection signal to the controller when the manually-inserted sheet 18 is supplied from the feeder 19 into the sheet supply passageway 21. The stepping motor 36 is controlled by the controller 31 to rotate the sheet supply rollers 11 in the directions as indicated by the arrow B. The stepping motor 37 is controlled by the controller 31 to rotate the cassette sheet supply roller 13 in the direction as indicated by the arrow A. The LED 38 is turned on when a sheet jam occurs in the sheet supply device 1, thereby warning a user of an error.

Figure 3:
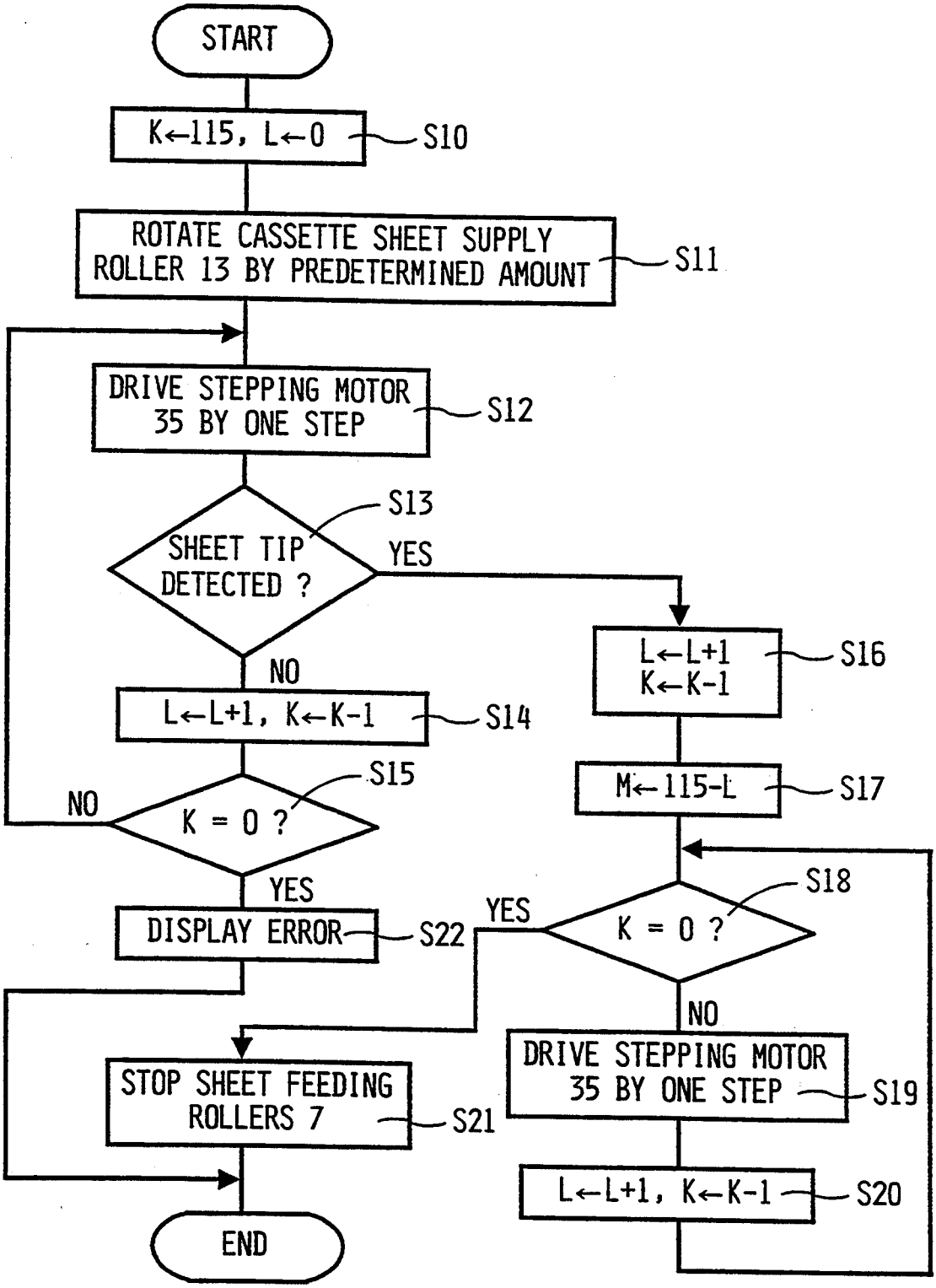
FIG. 3 is a flowchart for an operation of the sheet supply device in a residual step number detection process.
Figure 4:
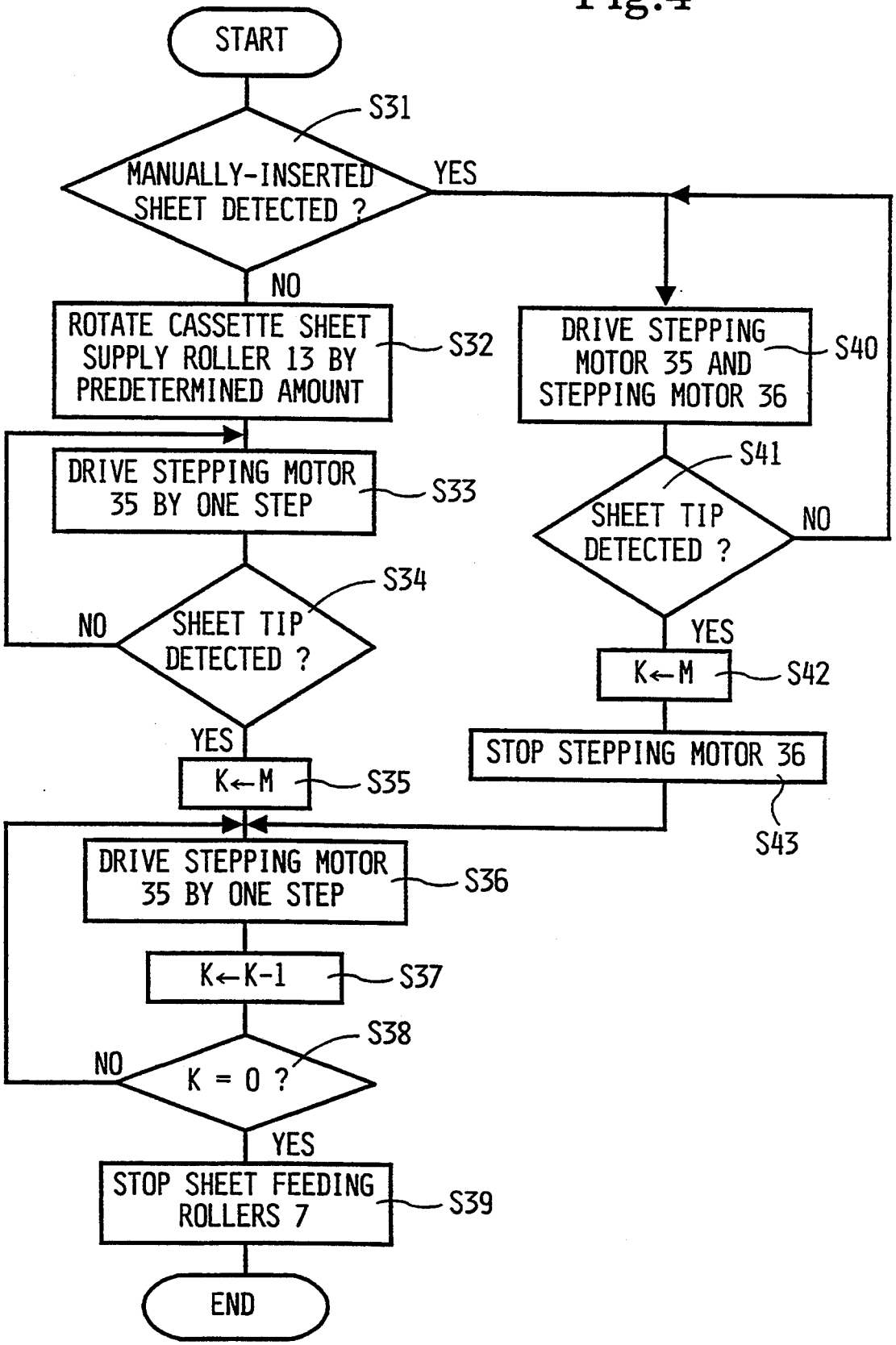
FIG. 4 is a flowchart for an operation of the sheet supply device in a sheet feeding process.
Figure 5:
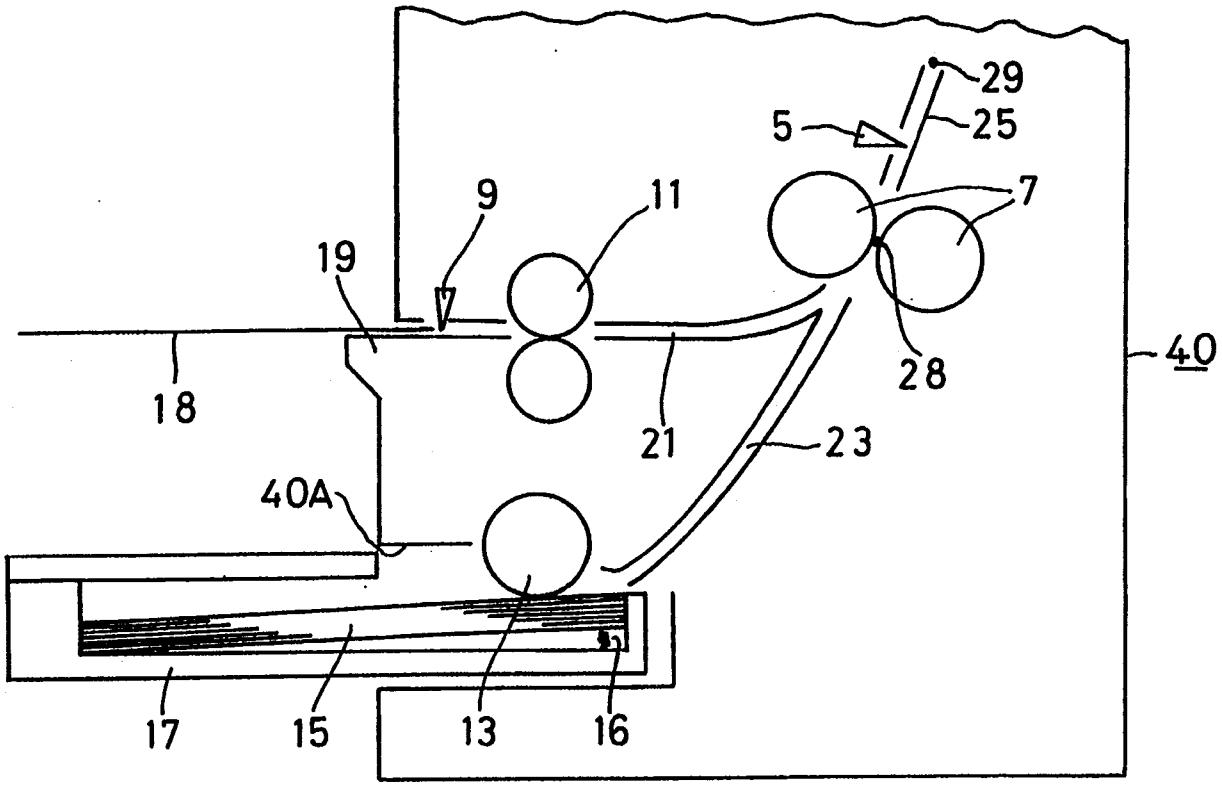
Fig.5 RELATED ART
FIG. 5 is a schematic diagram showing a conventional sheet supply device.

The operation of the sheet supply device 1 thus constructed is described with reference to FIGS. 3 and 4.

First, the user installs the sheet cassette 17 with the sheets 15 stacked therein through the opening 1A of the sheet supply device 1. At this time, each of the stepping motors 35, 36 and 37 are stopped. When the user presses a power switch (not shown), the controller 31 starts a residual step number detection processing as shown in FIG. 3. The residual step number detection processing determines a drive step number of the stepping motor 35 corresponding to the residual length of the sheet supply passageway 25 between the position where the tip portion of the sheet 15 or 18 is detected and the sheet supply completion position 29.

First, the controller 31 carries out an initial setting in which "115" is stored as a drive step number K in the drive step number storing area 33A of the RAM 33 and stores "0" as a step number L in the step number storing area 33B of the RAM 33 (step 10: hereinafter referred to as "S10".) The other step numbers are referred to as "Si" (i:integer).

Next, the controller 31 drives the stepping motor 37 by a predetermined amount to rotate the cassette sheet supply roller 13 in the direction as indicated by the arrow A. By this rotation, one sheet is separated from the sheets 15 in the sheet supply cassette 17 and is then fed through the sheet supply passageway 23 until the tip portion of the sheet 15 accurately arrives at the reference position 28 (S11). At this time, the feed amount of the sheet 15 by the cassette sheet supply roller 13 is set to such a value that the tip portion of the sheet 15 is slightly bent in contact with the reference position 28 of the sheet feeding rollers 7 to compensate for any positional deviation or distortion of the sheet 15.

Subsequently, the controller 31 drives the stepping motor 35 by one step to rotate the sheet feeding rollers 7 by one step. That is, the controller 31 feeds the tip portion of the sheet 15 by one step of the stepping motor 35 (S12).

Subsequently, the controller 31 determines whether the tip portion of the fed sheet 15 is detected by the sheet detection sensor 5 (S13). If the controller 31 determines that the tip portion of the fed sheet 15 is not detected by the sheet detection sensor 5, i.e., the tip portion of the sheet 15 is determined not to be fed to the position of the sheet detection sensor 5 (S13:No), the controller 31 increments the step number L of the step number storing area 33B by "1" and decrements the step number K of the drive step number storing area 33A by "1" (S14). Further, the controller 31 determines whether the step number K of the drive step number storing area 33A is equal to zero (S15). If the controller 31 determines that the step number K is equal to "0" (S15:No), the controller 31 repetitively executes the processing from S12. Through the repetitive processing of the controller 31 from S12 to S15, the sheet feeding rollers 7 are subsequently rotated by the stepping motor 35, and the sheet 15 is fed into the sheet supply passageway 25. At this time, the step number K of the drive step number storing area 33A and the step number L of the step number storing area 33B are successively altered by the controller 31 as described above.

When the tip portion of the sheet 15 is fed to the position where the sheet detection sensor 5 is secured by the next one step of the stepping motor 35 (S12), the controller 31 determines that the tip portion of the sheet 15 is detected (S13:Yes). The controller 31 bases this determination on the output signal of the sheet detection sensor 5. Subsequently, the controller 31 increments the step number L of the step number storing area 33B, and decrements the step number K of the drive step number storing area 33A by "1" (S16). Further, the controller 31 subtracts the step number L of the step number storing area 33B from the total step number "115" of the stepping motor 35 between the reference position 28 and the sheet supply completion position 29. The subtraction result is stored as the residual step number M into the residual step number storing area 33C of the RAM (S17). The residual step number M stored in the residual step number storing area 33C corresponds to the step number at which the stepping motor 35 is driven to feed the tip portion of the sheet 15 from the position where it is detected by the sheet detection sensor 5 to the sheet supply completion position 29. In this embodiment, the residual step number M is set to 50. Further, the controller 31 determines whether the step number K of the drive step number storing area 33A is equal to "0" (S18). If the controller 31 determines that the step number K is not equal to "0" (S18:No), the controller 31 further drives the stepping motor 35 by one step to further rotate the sheet feeding rollers by one step (S19). The controller 31 increments the step number L of the step number storing area 33B by "1", and decrements the step number K of the drive step number storing area 33A by "1" (S20).

Through the repetitive execution of the controller 31 from S18 to S20, the sheet 15 is further fed to the sheet supply passageway 25. When the stepping motor 35 is driven by all 115 steps, the tip portion of the sheet 15 is fed to the sheet supply completion position 29. At this time, the controller 31 sets the step number K of the drive step number storing area 33A to "0" at the step S20. Thus, the controller 31 determines at S18 that the step number K of the drive step number storing area 33A is equal to "0" (S18:Yes). On the basis of this determination, the controller 31 stops the driving of the stepping motor 35 to stop the sheet feeding rollers 7 (S21) and terminates the residual step number detection processing.

The residual step number detection processing determines a step number of the stepping motor that is required to feed the tip portion of the sheet 15 from the position where the tip portion is detected by the sheet detection sensor 5 to the sheet supply completion position 29. In this embodiment, 50 steps corresponding to the determined step number is stored as the step number M in the residual step number storing area 33C. After the residual step number detection processing is terminated, the controller 31 further rotates the sheet feeding rollers 7 and drives a well-known sheet discharge mechanism to discharge the sheet 15 or 18 to the outside of the sheet supply device 1.

On the other hand, if the controller 31 determines at the step S15 that the step number K is equal to "0" (S15:Yes), the controller 31 sends a signal via the LED 38 and warns the user of an error such as a sheet jam or the like (S22). When the step number K is equal to "0" at step S15, it means that the stepping motor 35 is driven 115 steps before the tip portion of the sheet is detected. In this case, the user starts the sheet supply device 1 again after removing the cause of the error. The residual step number detection processing of this embodiment is carried out only once at the sheet supply operation from the sheet supply cassette 17 after the power-on operation.

After the determination of step number M of the stepping motor required to feed the tip portion of the sheet 15 from the position where the tip portion of the sheet 15 is detected by the sheet detection sensor 5 to the sheet supply completion position 29, the sheet feeding processing commences. In the operation of this sheet feeding processing shown in FIG. 4, the controller 31 first determines whether the sheet detection sensor 9 detects the manually-inserted sheet 18 in the sheet supply passageway 21 (S31).

If the manually-inserted sheet 18 is not supplied into the sheet supply passageway 21, i.e., the controller 31 determines that the manually-inserted sheet detection sensor does not detect the manually-inserted sheet 18 in the sheet supply passageway 21 when the user presses a sheet supply button (not shown) or the like (S31:No), the controller 31 drives the stepping motor to rotate the cassette sheet supply roller 13. The cassette sheet supply roller 13 rotates in the direction indicated by the arrow A by a predetermined amount, whereby the sheet 15 in the sheet supply cassette 17 is fed until the tip portion thereof surely arrives at the reference position 28 (S32). At this time, the feed amount of the sheet 15 by the cassette sheet supply roller 13 is set to such a value that the tip portion of the sheet 15 is slightly bent in contact with the reference position 28 of the sheet feeding rollers 7 to compensate for any positional deviation or distortion of the sheet 15.

Subsequently, the controller 31 drives the stepping motor 35 by one step to rotate the sheet feeding rollers 7 in the direction as indicated by the arrow C by the amount corresponding to one step (S33). Through the rotation of the sheet feeding rollers 7, the sheet 15 is fed by a predetermined amount from the reference position 28 to the sheet supply completion position 29 in the sheet supply passageway 25. Thereafter, the controller 31 determines whether the tip portion of the fed sheet 15 is detected by the sheet detection sensor 5 (S34).

If the controller 31 determines that the tip portion of the sheet 15 is not detected by the sheet detection sensor 5 (S34:No), the controller 31 repetitively executes the processing from S33.

When through the repetitive execution of the steps S33 and S34 the tip portion of the sheet 15 is fed to the position where it is detected by the sheet detection sensor 5, the controller 31 determines that the tip portion of the sheet 15 is detected by the sheet detection sensor 5 (S34:Yes). Also, the step number M(=50) stored in the residual step number storing area 33C of the RAM 33 is stored in the drive step number storing area 33A (S35).

Through this operation, the value of the drive step number M of the step motor 35 required to feed the tip portion of the sheet 15 from the detection position of the sheet detection sensor 5 to the sheet supply completion position 29, and determined in the residual step number detection processing described above, is stored as the step number K in the drive step number storing area 33A. The step number K is the number of steps Chat the stepping motor 35 will be driven after the tip portion of the sheet 15 is detected by the sheet detection sensor 5.

The controller 31 drives the stepping motor 35 by one step to rotate the sheet feeding rollers in the direction as indicated by the arrow C by the amount corresponding to the one step, whereby the sheet 15 is further fed toward the sheet supply completion position 29 (S36). Then, the controller 31 subtracts "1" from the step number K stored in the drive step number storing area 33A of the RAM 33 (S37). Further, the controller 31 determines whether the step number K is equal to "0" (S38). If the controller 31 determines that the step number K is not equal to "0" (S38:No), the controller 31 repetitively executes the processing from S36. If the controller 31 determines that the step number K is equal to "0" (S38:Yes), the controller 31 stops the stepping motor 35 (S39) and terminates the sheet feeding processing. At this time, the tip portion of the sheet 15 is fed to the sheet supply completion position 29.

Through this operation, the tip portion of the sheet 15 is fed by the length between the detection position of the sheet detection sensor 5 and the sheet supply completion position 29 (corresponding to 50 steps of the stepping motor 35) after detection by the sheet detection sensor 5. So, the tip portion of the sheet 15 is necessarily located at the sheet supply completion position 29 when the operation is finished.

On the other hand, if the manually-inserted sheet 18 is supplied from the feeder 19 into the sheet supply passageway 21 when the user presses sheet supply button (not shown), i.e., if the controller 31 determines that the manually-inserted sheet detection sensor 9 detects the sheet 18 in the sheet supply passageway 21 (S31:Yes), the controller 31 drives the stepping motor 35 and the stepping motor 36 by one step respectively (S40). Thus, the manually-inserted sheet supply rollers 11 and the sheet feeding rollers 7 rotate in the directions as indicated by the arrow B and C, respectively. Therefore, the manually-inserted sheet 18 is guided from the feeder 19 to the sheet supply passageway 21, and fed toward the sheet supply completion position 29 by one step. Subsequently, the controller 31 determines whether the tip portion of the manually-inserted sheet 18 is detected by the sheet detection sensor 5 (S41). If the controller 31 determines that the tip portion of the manually-inserted sheet 18 is not detected by the sheet detection sensor 5 (S41:No), the controller 31 repetitively executes the processing from S31. If the controller 31 determines that the tip portion of the manually-inserted sheet 18 is detected by the sheet detection sensor 5 (S41:Yes), the controller 31 stores the step number M (=50) stored in the residual step number storing area 33C of the RAM 33 into the drive step number storing area 33A (S42).

Through this operation, the value of the drive step number M of the stepping motor 35 required to feed the tip portion of the sheet 15 or the manually-inserted sheet 18 from the detection position of the sheet detection sensor 5 to the sheet supply completion position 29, determined in the residual step number detection processing above, is stored as the step number K in the drive step number storing area 33A. The step number K is the number of steps that the stepping motor 35 will be driven after the tip portion of the sheet 15 is detected by the sheet detection sensor 5.

When the manually-inserted sheet 18 is fed to the position where the tip portion of the manually-inserted sheet 18 is detected by the sheet detection sensor 5, the controller 31 stops the stepping motor (S43) because the manually-inserted sheet 18 has been already separated from the sheet rollers 11. Subsequently, the controller 31 executes the processing from S36 as described above.

Through this operation, the tip portion of the manually-inserted sheet 18 manually supplied from the feeder 19 is fed by the length (corresponding to 50 steps of the stepping motor 35) between the detection position of the sheet detection sensor 5 and the sheet supply completion position 29. So, the tip portion of the manually-inserted sheet 18 is necessarily located at the sheet supply completion position 29 when the operation is finished. Further, the sheet supply device of this embodiment may be designed so that the sheet width or other parameter of the sheet 15 is detected after the tip portion of the sheet is fed to the sheet supply completion position.

Apparent from the foregoing, according to the sheet supply device of this invention, the tip portion of the sheet can be accurately fed to the sheet supply completion position irrespective of the difference of the origin of the sheet, i.e. manually-inserted or fed from the sheet supply cassette. Further, there is no error in the position that the sheet detection sensor 5 is located and no inherent read-out (detection) error of the sheet detection sensor 5. Accordingly, in a printing device, a copying machine or the like which is equipped with the sheet supply device of this invention, an image can be surely formed at a predetermined position on a sheet through a printing operation, a copying operation or the like.

This invention is not limited to the above embodiment, and various modifications may be made without departing from the subject matter of this invention.

For example, in this embodiment, the residual step number detection processing is carried out only once in a sheet supply operation from the sheet supply cassette 17 after a power source is switched on. However, as shown in FIG. 1, it may be carried out when the step detection start switch 39 is pushed by the user.

When the first sheet supply operation is carried out by the manually-inserted sheet supplied from the feeder 19, the residual step number detection processing may be carried out by feeding the sheet from the sheet supply cassette before the sheet supply operation.

In this embodiment, the first sheet is used only for the residual step number detection processing. However, it may be used for both the step number detection processing and the printing or the sheet feeding processing for printing. In this case, the first sheet can be effectively used.

Further, in this embodiment, the length between the reference position 28 and the sheet supply completion position 29 is set to 115/300 inch. Upon one-step drive of the stepping motor 35, the sheet is fed by 1/300 inch by the sheet feeding rollers 7. However, these set values may be altered in accordance with design differences.

Still further, in this embodiment, the step number M from the sheet detection sensor 5 to the sheet supply completion position 29 is set to 50. If the sheet detection sensor 5 is disposed at a position nearer to the sheet supply completion position 29 than the sheet detection sensor 5 (reference position 28), the step number determined in the residual step number detection processing would be smaller than 50. So, a sheet feeding error of the sheet 15, which would occur for a period when the stepping motor is driven at the above step number, can be significantly reduced.

What is claimed is:

1. A sheet supply device comprising:

a sheet supply;

a sheet passage extending from said sheet supply to a completion position;

a sheet feed mechanism located in said sheet passage and defining a contact point upstream of the completion position;

a drive mechanism coupled to said sheet feed mechanism;

a memory storing sheet feed data including data relating to a distance between the contact point and the completion position.;

a sheet detector located in said sheet passage between said contact point and the completion position and spaced from said contact point by a distance, said sheet detector outputting a signal when a sheet edge is detected; and a controller coupled to said memory, said drive mechanism and said sheet detector, said controller determining a sheet feed amount for said drive mechanism to feed a sheet to the completion position based on the distance between the contact point and the sheet detector determined by the signal output from said sheet detector and based on the distance between the contact point and the completion position stored in said memory.

2. The sheet supply device of claim 1, in combination with a reproduction assembly wherein a reproduction device is disposed at the completion position.

3. The sheet supply device of claim 1, wherein said sheet supply includes a manual feed supply and an automatic feed supply.

4. The sheet supply device of claim 3, wherein said manual feed supply includes a manual sheet feed detector and a manual feed device.

5. The sheet supply device of claim 3, wherein said automatic feed supply includes a removable cassette and an automatic supply device, said automatic supply device being coupled to said controller.

6. The sheet supply device of claim 1, wherein said sheet feed mechanism is a pair of rollers that nip a sheet and the contact point is the nip point.

7. The sheet supply device of claim 1, wherein said drive mechanism is a stepping motor.

8. The sheet supply device of claim 7, wherein said memory stores a number of steps that said stepping motor is to be driven, a total number of steps that said stepping motor has been driven and a residual number of steps that said stepping motor is to be driven to feed a sheet to the completion position.

9. The sheet supply device of claim 1, wherein said controller sets an initial drive amount for said drive mechanism, controls said drive mechanism to incrementally feed a sheet through said sheet feed mechanism to said sheet detector, determines when said detector has output a signal, determines a driven amount driven by said drive mechanism to feed a sheet from the contact point to said sheet detector, and determines the sheet feed amount required to feed a sheet from said detector to the completion position.

10. The sheet supply device of claim 1, further comprising a warning device coupled to said controller warning of a sheet feeding error.

11. A sheet supply device, comprising:

first sheet feeding means for feeding a sheet to a first position;

guide means for guiding the sheet from the first position to a second position spaced downstream from the first position at a distance;

second sheet feeding means for feeding the sheet from the first position to the second position along the guide means;

detection means provided between the first position and the second position for detecting a tip portion of the sheet fed by the second sheet feeding means;

residual distance determining means for determining a residual distance from the detection means to the second position based on the distance between the first position and the second position and a sheet feed amount of when the sheet is fed by the second sheet feeding means to the detection means; and control means for controlling the second sheet feeding means to feed subsequent sheets to the detection means and to the second position in accordance with the residual distance determined by the residual distance determining means.

12. The sheet supply device of claim 11, wherein said first sheet feeding means comprises a manual feed device and an automatic feed device.

13. The sheet supply device of claim 12, wherein said manual feed device includes a manual sheet feed detector and a pair of manual feed rollers coupled to a drive mechanism.

14. The sheet supply device of claim 12, wherein said automatic feed device includes a removable cassette and an automatic supply roller coupled to a drive mechanism.

15. The sheet supply device of claim 11, wherein said second sheet feeding means comprises a pair of feed rollers and a drive mechanism coupled thereto.

16. The sheet supply device of claim 15, wherein said drive mechanism is a stepping motor.

17. The sheet supply device of claim 11, further comprising a memory means for storing an initial feed amount for said second sheet feeding means, a driven amount required for a sheet to reach said detection means from said second sheet feeding means, and the residual distance.

18. A method of feeding a sheet, comprising the steps of:

feeding a sheet to a first point at a sheet feed device;

setting an initial drive amount for the sheet feed device to feed a sheet to a completion point;

incrementally feeding the sheet through the sheet feed device from the first point to a second point;

detecting an edge of the sheet fed from the sheet feed device at the second point;

determining a sheet feed amount driven by the sheet feed device to feed the sheet from the first point to the second point;

determining a residual distance from the second point to the completion point based on the sheet feed amount and the initial drive amount; and controlling the sheet feed device to feed subsequent sheets to the completion point based on the residual distance.

19. The method of claim 18, wherein the step of incrementally feeding includes driving a stepping motor.

20. The method of claim 18, wherein the step of feeding the sheet to the sheet feed device includes the step of feeding a sheet from at least one of a manual sheet feeding device and an automatic sheet feeding device.

* * * * *